US010987566B2

(12) United States Patent
Ferras

(10) Patent No.: US 10,987,566 B2
(45) Date of Patent: Apr. 27, 2021

(54) SYSTEM AND METHODS FOR GOLF BALL LOCATION MONITORING

(71) Applicant: Dish Network L.L.C., Englewood, CO (US)

(72) Inventor: Leo James Ferras, Oregon House, CA (US)

(73) Assignee: Dish Network L.L.C., Englewood, CO (US)

( * ) Notice: Subject to any disclaimer, the term of this patent is extended or adjusted under 35 U.S.C. 154(b) by 43 days.

(21) Appl. No.: 16/286,272

(22) Filed: Feb. 26, 2019

(65) Prior Publication Data

US 2020/0269121 A1 Aug. 27, 2020

(51) Int. Cl.

| | |
|---|---|
| ***A63B 71/06*** | (2006.01) |
| ***A63B 24/00*** | (2006.01) |
| *A63B 102/32* | (2015.01) |

(52) U.S. Cl.

CPC ..... *A63B 71/0622* (2013.01); *A63B 24/0021* (2013.01); *A63B 2024/0034* (2013.01); *A63B 2024/0053* (2013.01); *A63B 2071/0625* (2013.01); *A63B 2071/0691* (2013.01); *A63B 2102/32* (2015.10); *A63B 2220/802* (2013.01); *A63B 2220/803* (2013.01); *A63B 2220/805* (2013.01); *A63B 2220/89* (2013.01)

(58) Field of Classification Search

CPC ..... G01S 19/19; G01S 7/003; G01S 13/88; G01S 13/876; G01S 13/34; G05D 1/0088; A63B 2071/0691; A63B 57/00

USPC ..... 700/91

See application file for complete search history.

(56) References Cited

U.S. PATENT DOCUMENTS

| | | | | |
|---|---|---|---|---|
| 6,176,789 | B1 * | 1/2001 | Kluttz | A63B 24/0021 473/192 |
| 6,620,057 | B1 * | 9/2003 | Pirritano | A63B 24/0021 342/51 |
| 8,715,078 | B1 * | 5/2014 | White | G09F 27/005 463/30 |
| 9,138,638 | B2 * | 9/2015 | Bastawros | A63F 13/00 |
| 2009/0036237 | A1 * | 2/2009 | Nipper | A63B 60/46 473/409 |
| 2013/0260922 | A1 * | 10/2013 | Yontz | A63B 69/36 473/409 |
| 2014/0297007 | A1 * | 10/2014 | Voutilainen | A63B 69/3608 700/91 |
| 2015/0343294 | A1 * | 12/2015 | Leech | A63B 24/0021 473/209 |
| 2016/0030819 | A1 * | 2/2016 | Ahn | A63B 69/3623 473/192 |

(Continued)

*Primary Examiner* — Michael A Cuff

(74) *Attorney, Agent, or Firm* — Seed IP Law Group LLP

(57) ABSTRACT

Technologies are disclosed herein for one or more sensors arrayed adjacent to a golf course playing surface to track the trajectory and determine a resting location of a golf ball it travels along the golf course playing surface. The sensors may include motion detecting sensors that may determine various measurements related to the location and/or movement of the golf ball, such as an initial impact location, a velocity, and/or a direction of travel of the golf ball along the golf course playing surface. The signals from the motion detecting sensors may further be used to determine a resting location for the golf ball and/or a rate of acceleration/deceleration of the golf ball. The various signals may be averaged together to determine a velocity and/or direction of travel of the golf ball.

20 Claims, 14 Drawing Sheets

(56) References Cited

U.S. PATENT DOCUMENTS

| | | | | |
|---|---|---|---|---|
| 2016/0306036 | A1* | 10/2016 | Johnson | G01S 13/867 |
| 2018/0011184 | A1* | 1/2018 | Du Toit | G01S 13/88 |
| 2018/0280781 | A1* | 10/2018 | O'Connor | A63B 69/36213 |
| 2019/0388729 | A1* | 12/2019 | Shimizu | A63B 1/00 |
| 2020/0108302 | A1* | 4/2020 | Marten | A63B 57/00 |
| 2020/0108303 | A1* | 4/2020 | Marten | G01N 33/246 |
| 2020/0139216 | A1* | 5/2020 | Lee | G06F 3/04847 |

* cited by examiner

SYSTEM AND METHODS FOR GOLF BALL LOCATION MONITORING

BACKGROUND

Technical Field

The present disclosure relates to methods and systems for determining locations of items on the golf course.

Description of the Related Art

Golf is a popular sport with many different types of players. One of the potentially frustrating parts of playing golf is hunting for the golf ball after it has been struck by the player. This frustration can occur when the golf ball remains on the fairway or greens area, or when the golf ball goes off of the golf course playing surface, such as may occur when the golf ball goes into the rough that is adjacent to the golf course playing surface.

Various tactics have been used to assist golf players in locating their golf ball. In some instances, for example, the golf ball may contain a small transmitter or transceiver that may be used to transmit a signal that may be used by an appropriate receiver to detect the golf ball. In such instances, the golf player may use such a receiver to locate the golf ball within or along the golf course playing surface. In some instances, the signals associated with different golf balls may be differentiated, such as by using different frequencies, to differentiate between different golf balls.

BRIEF SUMMARY

By using one or more sensors arrayed adjacent to the golf course playing surface, the trajectory of the golf ball may be tracked as it travels along the golf course playing surface. The sensors may include, for example, motion detecting sensors that may be used to determine various measurements related to the location and/or movement of the golf ball. For example, the motion detecting sensors may determine an initial impact location, a velocity, and/or a direction of travel of the golf ball along the golf course playing surface. The signals from the motion detecting sensors may further be used to determine a resting location for the golf ball and/or a rate of acceleration/deceleration of the golf ball, based, for example, upon multiple measurements of velocity over time.

In some instances, signals from a plurality of sensors may be used to determine location and/or movement information for the golf ball. In such instances, for example, the various signals may be averaged together to determine a velocity and/or direction of travel of the golf ball. In some instances, the averaging may be determined using a weighted average of the signals received from a plurality of sensors. As such, the signals that are relatively stronger may be weighted relatively more than those signals that are relatively weaker. In some implementations, the resting location of the golf ball may be determined using the initial impact location, velocity, and direction of travel detected for the golf ball. In some instance, the topography of the golf course playing surface may be taken into account to estimate or determine the final resting location.

The signals from one or more of the motion detecting sensors may be used to identify a ricochet of the golf ball, which may occur, for example, when the golf ball strikes an obstacle that is proximate the golf course playing surface. Such a ricochet may be identified, for example, when the signals from the motion detecting sensor shows a change in trajectory of the golf ball from a first trajectory to a second, different trajectory. In such an instance, the velocity and new direction of travel of the golf ball may be used to identify a resting location of the golf ball along or adjacent the golf course playing surface.

Such tracking of the golf balls may be used to reduce the incidents of lost golf balls, to provide additional analytics to golf players to assist in improving the games of the respective golf players, and/or to improve efficiency of the golf club by improving the speed at which players can complete each hole and/or by providing improving estimates as to when each party of golf players will start its game.

DETAILED DESCRIPTION

Figure 1:
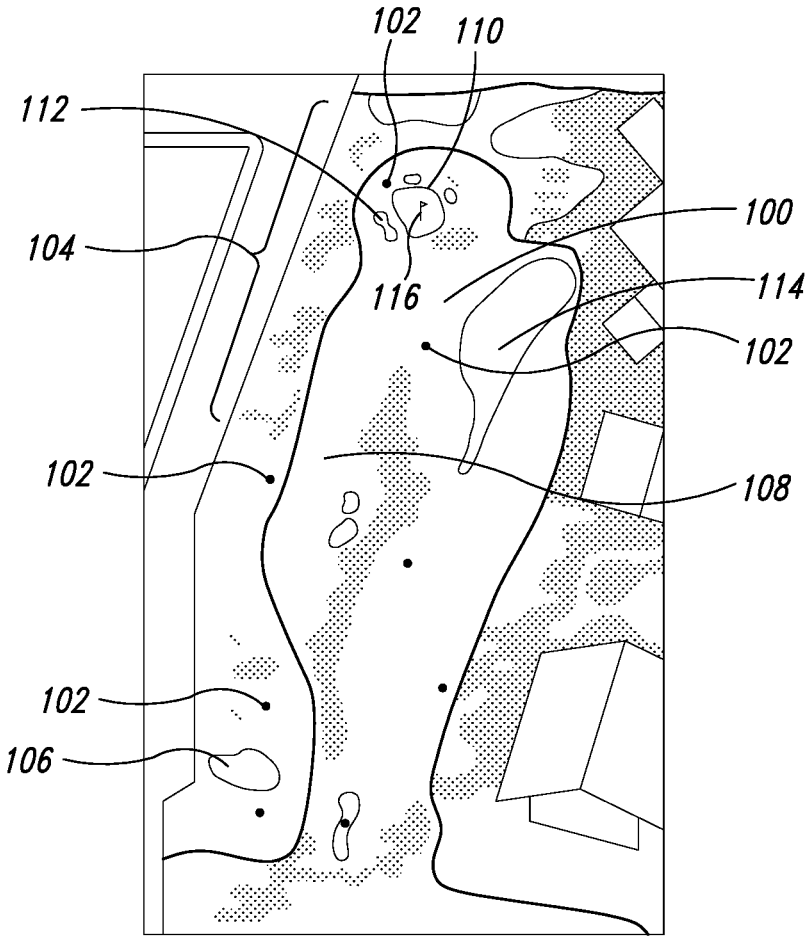
FIG. 1 illustrates a plan view of a golf course playing surface that includes a plurality of sensors that may be used to sense a location of a golf ball.

FIG. 1 shows a golf course playing surface 100 that includes one or more sensors 102 that form an array of sensors 104. In some implementations, for example, one or more of the sensors 102 in the array of sensors 104 may include motion detector sensors that detect movement of objects. Some implementations one or more of the sensors 102 in the array of sensors 104 may include sensors that capture one or more images from the golf course playing surface 100. Some implementations one or more of the sensors 102 in the array of sensors 104 may include sound detecting sensors. Accordingly, the array of sensors 104 may be comprised of the same type or different types of sensors 102.

The golf course playing surface 100 may include a tee area 106, a fairway 108, a greens area 110, and one or more obstacles, such as sand pits 112 and water features 114. The greens area 110 includes a hole 116 that serves as the desired destination of the golf ball. Different types of sensors 102 may be located in different areas of the golf course playing surface. For example, sound sensors may be located at or proximate the tee area 106, whereas one or more motion detecting sensors may be located at or proximate the fairway 108. In some implementations, the one or more motion detecting sensors 102 located along the fairway 108 may be used to detect the movement of a golf ball along golf course playing surface 100. In such implementations, a resting location of the golf ball may be determined by using the signals captured by the one or more sensors 102 in the array of sensors 104.

Figure 2:
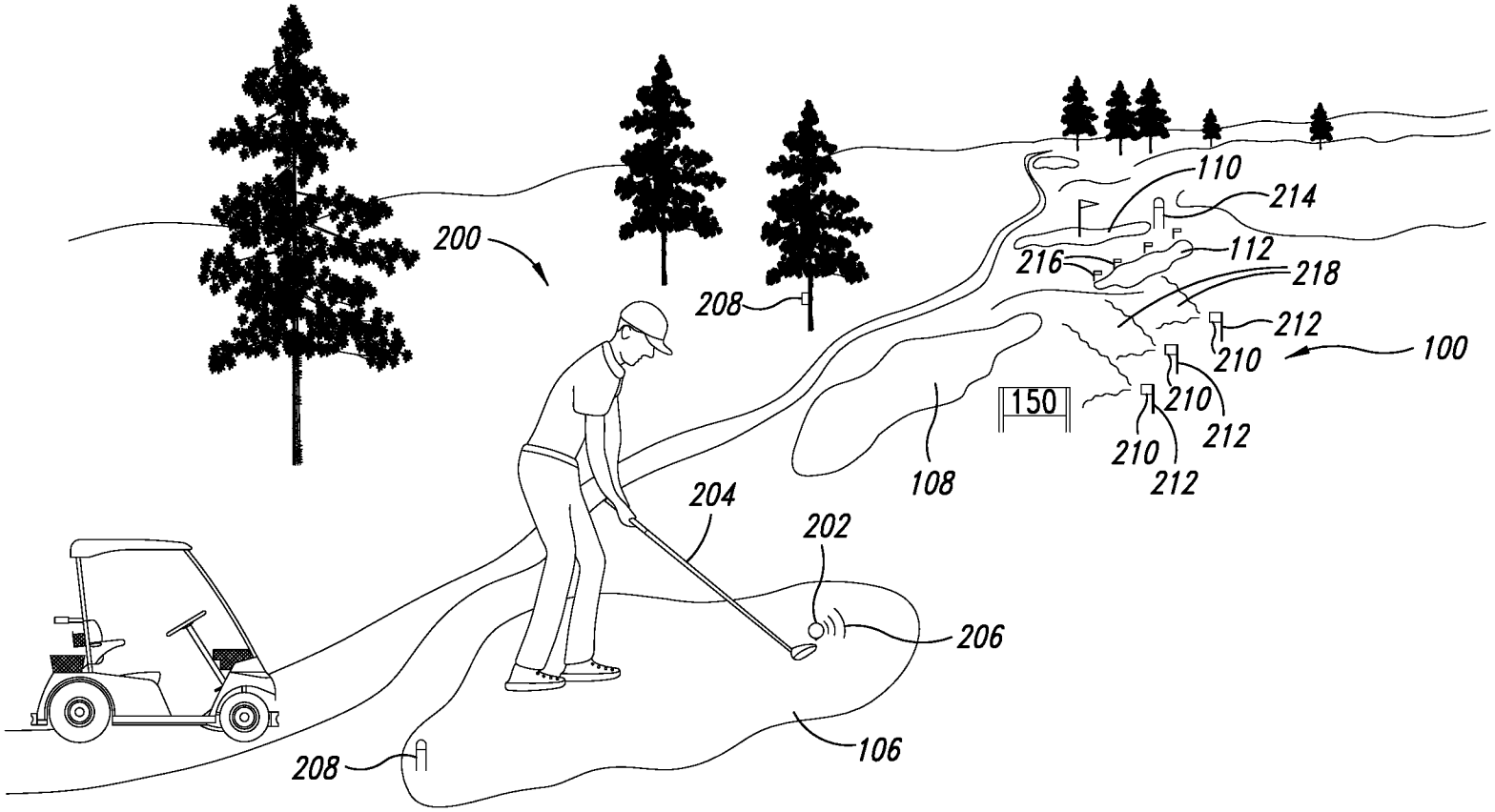
FIG. 2 illustrates an isometric view of player hitting a golf ball at a golf course playing surface that includes one or more sensors.

FIG. 2 shows a player 200 striking a golf ball 202 at tee area 106 in a golf course playing surface 100. As shown in FIG. 2, the striking of golf ball 202 by the player 200 using a golf club 204 may produce sound waves 206 originating at the location at which the golf ball 202 struck. In this situation the golf ball 202 travels along the golf course playing surface 100 preferably towards the greens area 110 and the hole 116. In some implementations, an audio transducer 208 may be located proximate the tee area 106 and may be used, for example, to detect the soundwaves 206 generated when a head of the golf club 204 strikes the golf ball 202. In some implementations, the detection of the soundwaves by the s audio transducer 208 may be used to control the operation of other various sensors located further along the golf course playing surface. For example, some of the notations, the detection of the soundwaves by the audio transducer 208 may be used to turn on or activate sensors located at the fairway 108 and/or the greens area 110.

In such an implementation, one or more motion detecting sensors 210 may be located along the fairway 108. The motion detecting sensors 210 may be placed at elevated positions to facilitate detecting the golf ball 202 as it travels along the golf course playing surface 100. Elevating the motion detecting sensors 210 may also protect the motion detecting sensors 210 from being damaged, such as by players or by equipment used to maintain the golf course playing surface 100. As shown in FIG. 2, for example, the motion detecting sensors 210 located along the fairway 108 may be placed on posts 212 that are stuck into the ground. In addition, or alternatively, the motion detecting sensors 210 located along the fairway 108 may be placed in a tree or other obstacle that is located along the fairway 108. When multiple motion detecting sensors 210 are located along the fairway 108, signals generated by a plurality of the motion detecting sensors 210 may be used to determine the location of the golf ball 202 as it travels along and comes to arrest in the golf course playing surface 100.

In some implementations, the motion detecting sensors 210 may include infrared sensors that transmit infrared signals in a field of view 218. As objects, such as a golf ball, travel through the field of view 218, at least a portion of the infrared signals transmitted into the field of view 218 will be reflected back from the golf ball to the motion detecting sensors 210. In some implementations, the motion detecting sensors 210 may include ultrasound sensors that transmit ultrasound signals in a field of view (not shown). As objects, such as a golf ball, travel through the field of view, at least a portion of the ultrasound signals transmitted into the field of view will be reflected back from the golf ball to the motion detecting sensors 210.

One or more sensors 214 may be located proximate the greens area 110. In some implementations, for example, the sensor 214 located proximate the greens area 110 may include one or more image capture devices. Such image capture devices may be used to determine a resting location of the golf ball 202 along or proximate the greens area 110. Some implementations, the sensors 214 may include one or more motion detecting sensors may be used to detect motion of the golf ball 202 proximate the greens area 110. In some implementations, one or more sensors 216 may be located proximate or with in one or more of the obstacles or hazards, such as the sandpit 112. In some implementations, the sensors 216 located near proximate obstacles may include one or more sound sensors. Such sound sensors may be used to detect sounds associated with the golf ball 202 striking or making contact with the substance comprising the obstacle, e.g., sand or water.

Figure 3A:
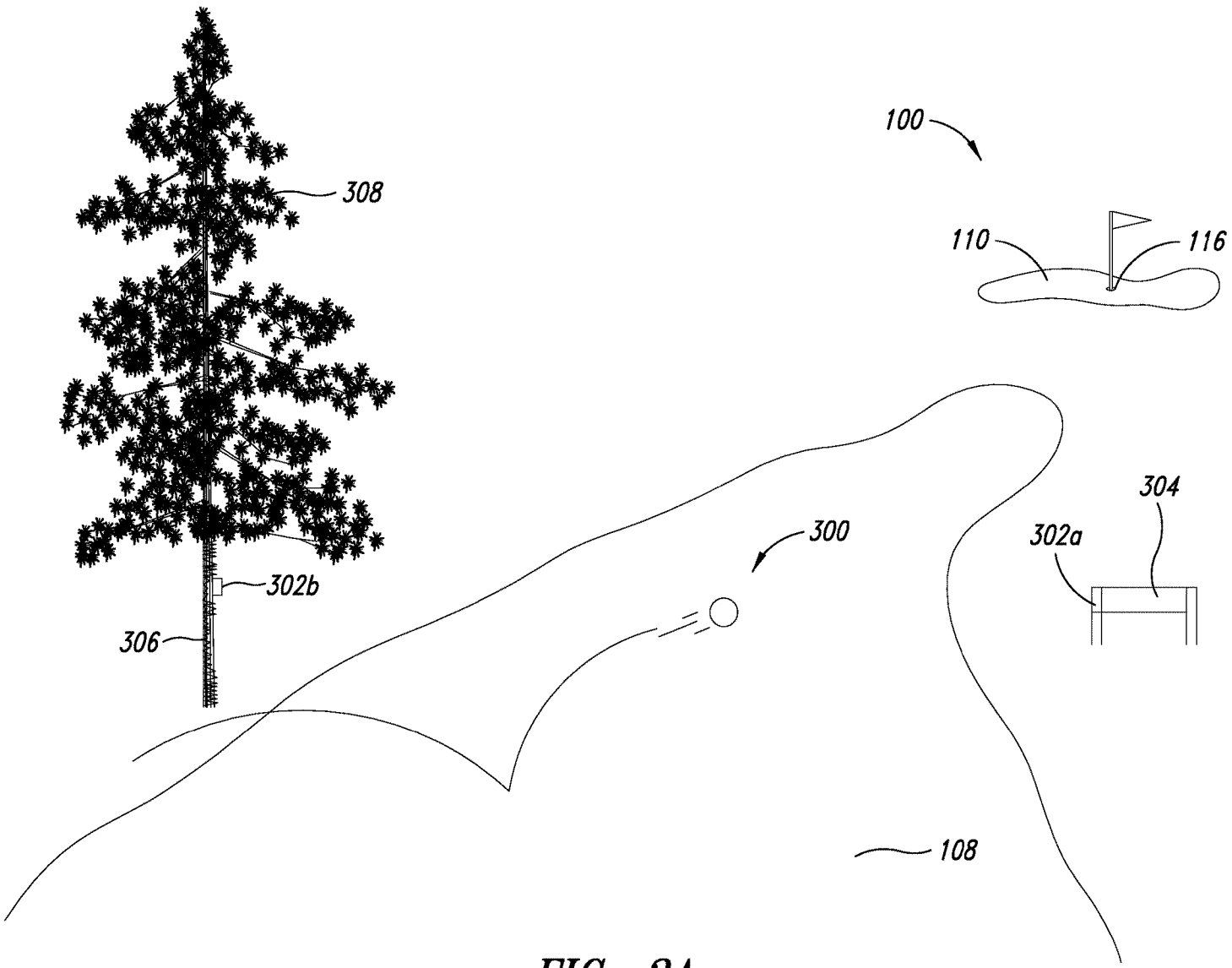
FIG. 3A illustrates an isometric view of a golf ball traveling along the golf course playing surface after being struck by a player.

FIG. 3A shows a golf ball 300 traveling along a golf course playing surface 100 after being struck by a player. Golf ball 300 is traveling along the fairway 108 of the golf course playing surface 100. A plurality of motion detecting sensors 302 located along the fairway 108. For example, a first motion detecting sensor 302*a* may be located on a yardage sign 304 is located proximate the fairway 108 of the golf course playing surface 100. Message yardage signs 304 may be located at predetermined locations along the fairway 108. For example, in some instances, yardage signs may be located every one-hundred yards along the fairway 108 from the tee area 106. A second motion detecting sensor 302*b* may be placed at elevated positions along clock 36 of the tree 308 that is located along the fairway 108 the golf course playing surface 100. Motion detecting sensors may be elevated by placing the motion detecting sensors on other objects that are located on proximate the fairway 108 or other portions of the golf course playing surface 100.

The movement of the golf ball 300 along the golf course playing surface 100 may be determined using one or more of the signals generated by the sensors located proximate the golf course playing surface. For example, the motion detecting sensors 302 may each generate a signal in response to the motion of the golf ball 300 moving along the golf course playing surface 100. Such signals may be used to determine a location, speed, and direction of travel of the golf ball 300 along the golf course playing surface 100. In some implementations, the signals from the motion detecting sensors 302 may be combined to determine one or more measurements (e.g., location, speed, direction of travel) of the golf ball 300. For example, the signals from multiple motion detecting sensors 302 may be averaged together to determine one or more measurements for the golf ball 300. In some instances, a weighted average may be performed to determine one or more measurements for the golf ball 300. In such an instance, for example, the weighting of each signal from the motion detecting sensors 302 may be based upon the relative strength of each signal.

Figure 3B:
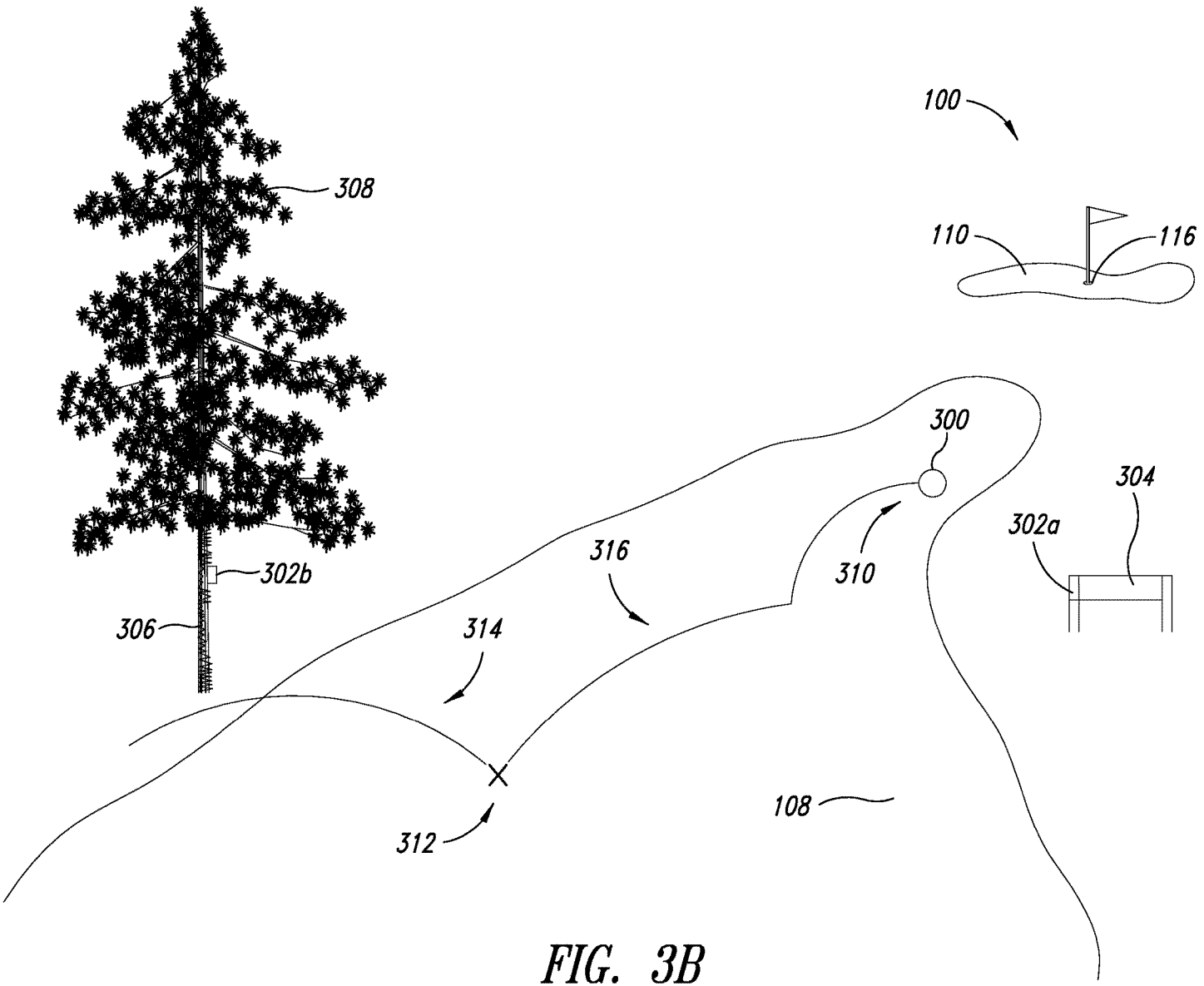
FIG. 3B illustrates an isometric view of a golf ball rolling towards a resting location along the golf course playing surface.

FIG. 3B shows the golf ball 300 rolling towards a resting location 310 along the golf course playing surface 100. The resting location 310 may be determined based upon one or more measurements of the golf ball 300 by one or more of the motion detecting sensors 302. For example, in some implementations, the signals from one or more of the motion detecting sensors 302 may be used to determine an initial impact location 312 at which the golf ball 300 initial impacted the fairway 108.

In such an implementation, the signals from the motion detecting sensors 302 may be used to detect a change in the direction of movement of the golf ball 300 from a generally downward trajectory 314 to a generally upward trajectory 316. The change in trajectory of the golf ball 300 may thereby be used to determine the initial impact location 312 of the golf ball 300 along the fairway 108. In addition, the signals from one or more of the motion detecting sensors 102 may be used to determine one or more measurements of the golf ball 300 such as the velocity and/or direction of travel of the golf ball 300 along the fairway 108. As such, the one or more measurements may be used to determine the resting location 310 of the golf ball 300 along the fairway 108. For example, multiple velocity measurements may be taken to determine a rate of acceleration and/or deceleration of the golf ball 300 along the fairway 108. The rate of acceleration and/or deceleration, the current velocity, and the direction of travel of the golf ball 300 may be used to determine the final resting location 310 of the golf ball 300. In some implementations, a processing device (not shown) may associate a distance value with a velocity or a range of velocities. In such an implementation, the processing device may include multiple ranges of velocities in which each range has an associated distance. Accordingly, upon determining the initial impact location 312, the velocity, and the trajectory of the golf ball 300, the processing device may be able to estimate the resting location 310 of the golf ball 300 based upon the distance value associated with the determined velocity.

Figure 4A:
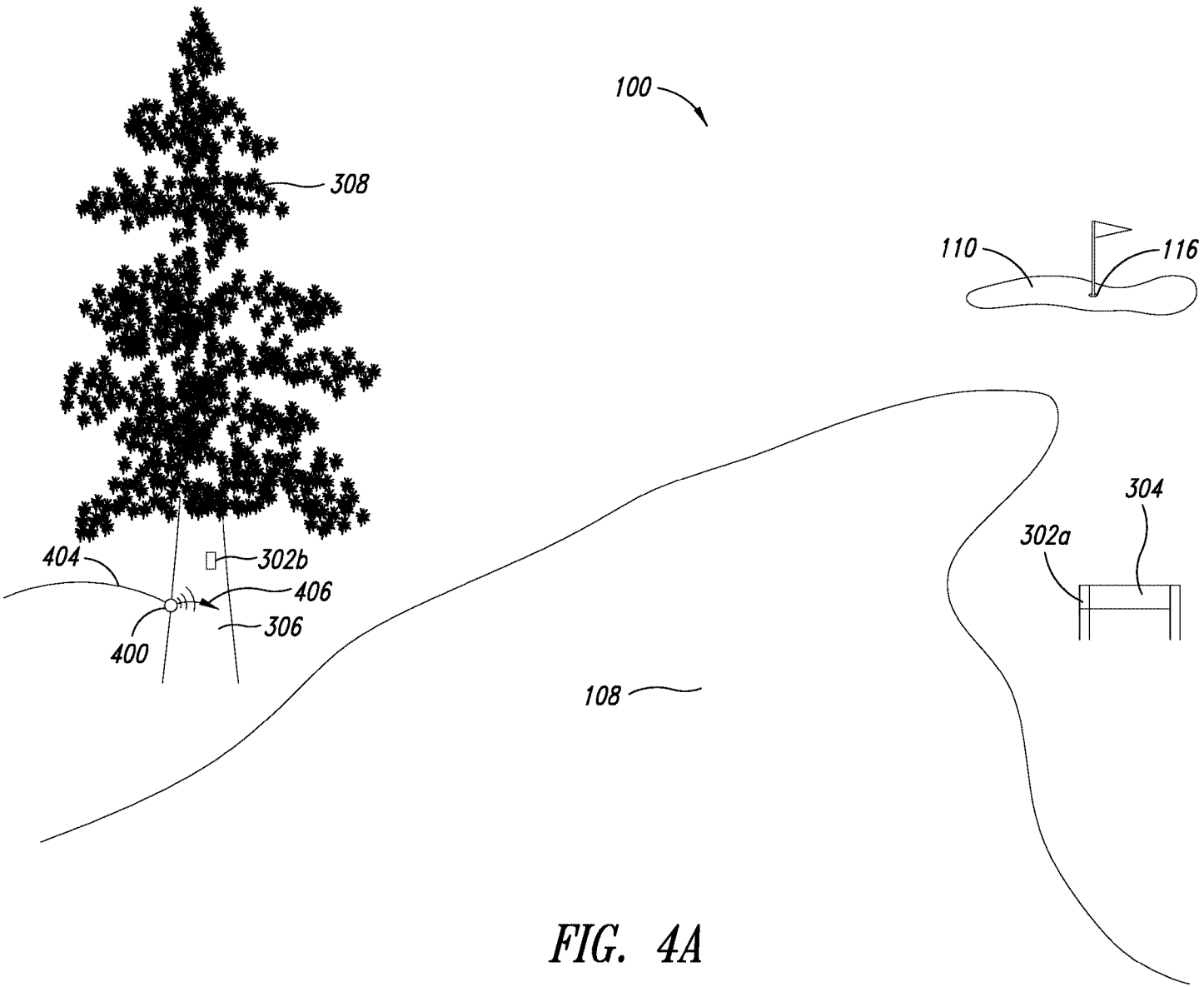
FIG. 4A illustrates an isometric view of a golf ball striking an obstacle, such as a tree, located along the side of a golf course playing surface.
Figure 4B:
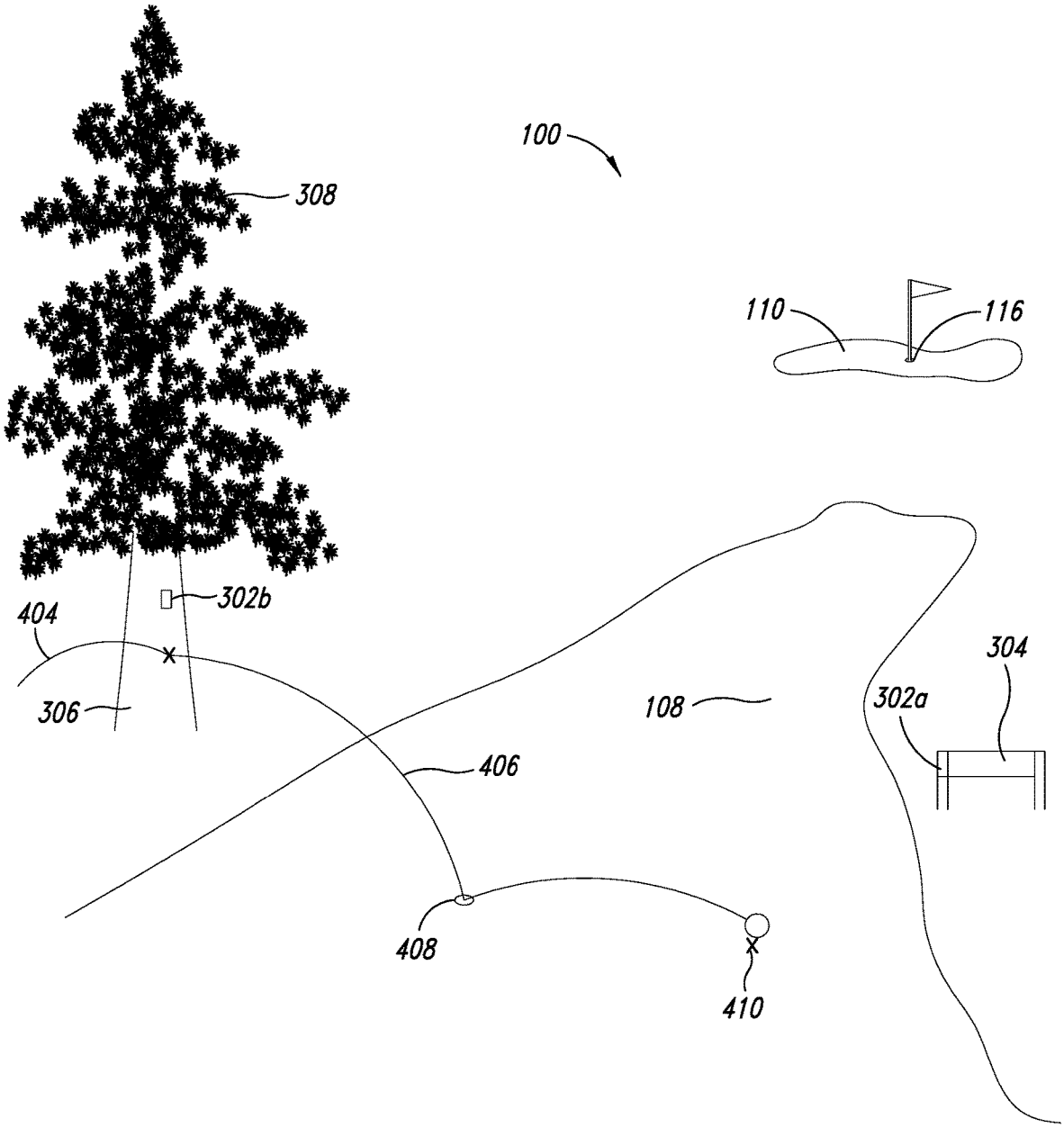
FIG. 4B illustrates an isometric view of a golf ball ricocheting off of an obstacle, such as a tree, located along the side of a golf course playing surface.

FIGS. 4A and 4B show a golf ball 400 striking an obstacle, such as a tree 308, located along the side of a golf course playing surface 100. In such a situation, the golf ball 400 may ricochet 402 off of the tree 308, thereby changing its direction of travel from a first direction 404 to a second direction 406. As such, an impact location 406 of the golf ball 400 on the tree 308 may be determined based upon a change in a direction of travel of the golf ball 400. The signals from one or more of the motion detecting sensors 302 may be used to detect the change of direction of the golf ball 400 as a result of the ricochet 402. As such, the signals may be used to determine the second direction 406 of travel of the golf ball 400.

In such an implementation, the signals from one or more of the motion detecting sensors 302 may be used to determine one or more other measurements of the golf ball 400, as described above. Such measurements may include the velocity and the acceleration/deceleration of the golf ball 400 along with the direction of travel. In some implementations, an initial impact location 408 of the golf ball 400 may also be determined, based, for example, on a change in trajectory of the golf ball 400 as described above. In such an implementation, a final resting location 410 of the golf ball 400 may be determined as described above.

Figure 5A:
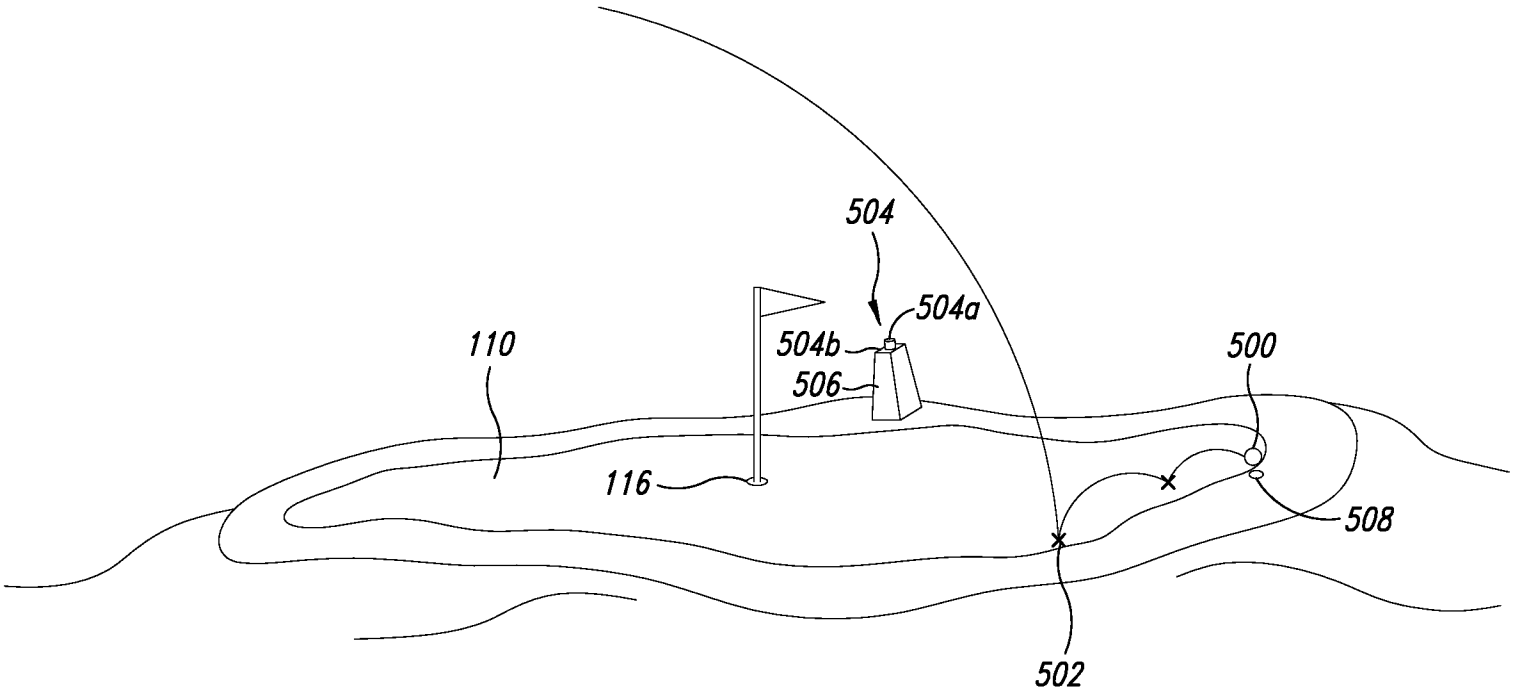
FIG. 5A illustrates an isometric view of a golf ball striking a golf course playing surface proximate a hole.
Figure 5B:
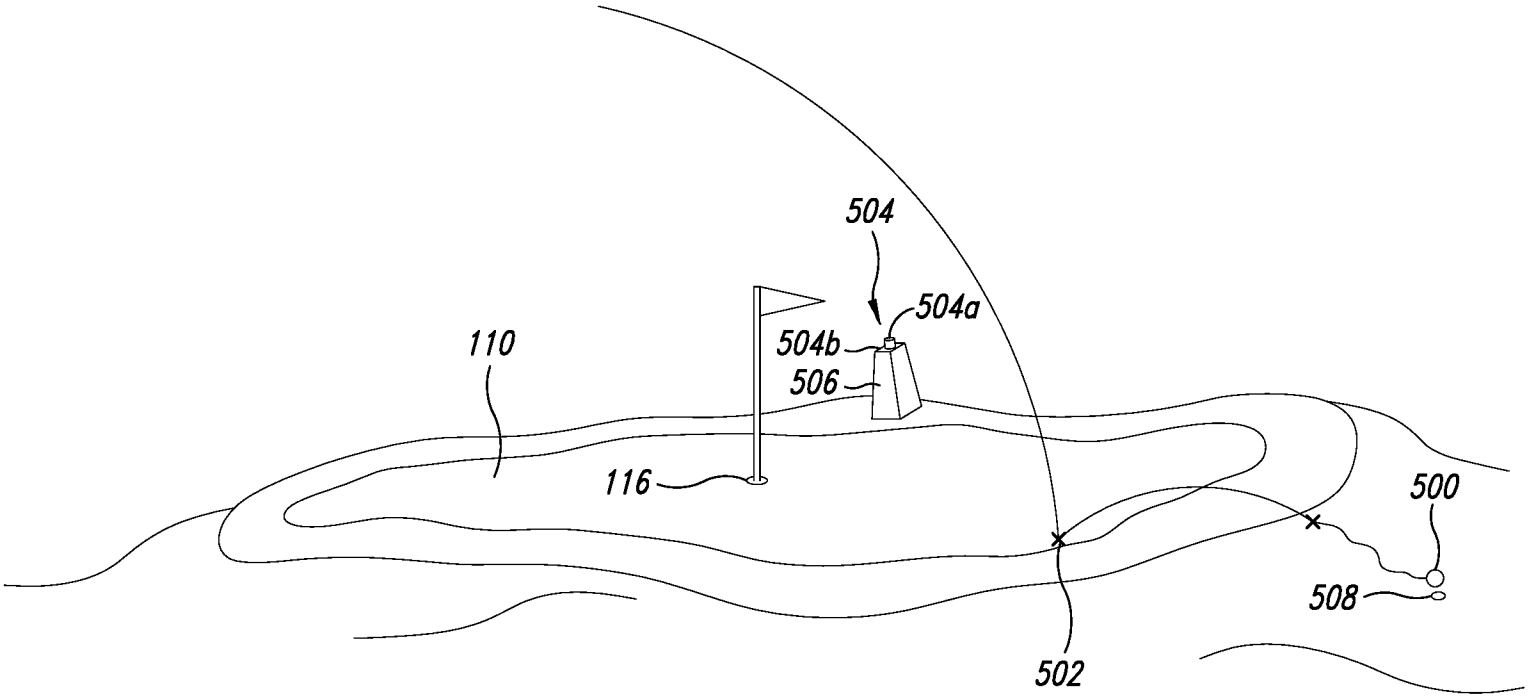
FIG. 5B illustrates an isometric view of the golf ball striking the golf course playing surface shown in FIG. 5 *a* and rolling away from the hole.

FIGS. 5A and 5B show a golf ball 500 striking a golf course playing surface 100 proximate a hole 116 located at a greens area 110. In such a situation, a player may strike the golf ball 500 from a tee area 106, from a fairway 108, from a hazard area (e.g., a sand pit 112), and/or from a location adjacent the fairway 108 (e.g., the rough) to reach the greens area 110. In such a situation, the golf ball 500 may have an initial impact location 502 on the greens area 110. As shown in FIGS. 5A and 5B, one or more sensors 504 may be located proximate the greens area 110, for example, such as on top of a post 506.

The sensor 504 may be one or more of a motion detecting sensor 504*a* or an image sensor 504*b* (collectively, sensors 504). In such a situation, the sensors 504 may be used to determine the initial impact location 502 of the golf ball 500. As discussed above, the motion detecting sensor 504*b* may determine the initial impact location 502 based upon a change of trajectory of the golf ball 500. The image sensor 504*a* may be used to determine the initial impact location 502 based upon image sensing techniques. In such situations, the image sensing techniques may be used, for example, to identify the presence of the golf ball 500 within multiple images that may be captured over a period of time. The direction of travel of the golf ball 500 may be determined by comparing the location of the golf ball 500 over multiple frames. The initial impact location 502 of the golf ball 500 may be determined by identifying a change of trajectory of the golf ball 500 from a downward trajectory to an upward trajectory from the multiple images captured by the image sensor 504*a*. In such situations, the velocity of the golf ball 500 may also be determined based upon the distance the golf ball 500 traveled between successive frames.

In the situation shown in FIG. 5A, the golf ball 500 may come to a resting location 506 on the greens area 110. In this situation, a processing device (not shown) may determine the resting location 506 based upon one or more signals from the sensors 504. In situations involving the image sensor 504*b*, the golf ball 500 may be detected in one or more images captured by the image sensor 504*a*. In such situations, the resting location 506 may be determined, for example, when the location of the golf ball 500 between successive images does not change. In situations involving the motion detecting sensor 504*b*, the resting location 506 may be determined as noted above. In some implementations, the resting location 506 may be determined based upon signals received from both the image sensor 504*a* and the motion detecting sensor 504*b*.

In the situation shown in FIG. 5B, the golf ball 500 may come to a resting location 508 that is off of the greens area 110. In this situation, the resting location 508 of the golf ball 500 may be outside of the images captured by the image sensor 504*a*. In this situation, the resting location 508 of the golf ball 500 may be determined based upon the images captured by the image sensor 504*a* and/or the signals from the motion detecting sensor 504*b*. In such situations, measurements of the golf ball 500 may be determined from the images captured by the image sensor 504*a* and/or the signals from the motion detecting sensor 504*b*. Such measurements may include, for example, the initial impact location 502, the direction of travel of the golf ball 500, the velocity of the golf ball 500, and/or the acceleration/deceleration of the golf ball 500. In some implementations, a processing device (not shown) may associate a distance with a set of velocity and direction of travel measurements. In such implementations, the processing device may include multiple sets of velocities and directions of travel, and associate a distance with each respective set of velocities and directions of travel. Such distances associated with each direction of travel may take into account the terrain of the golf course playing surface 100 in the direction of travel. As such, the processing device may estimate the resting location 508 of the golf ball 500 based upon the velocity and/or direction of travel determined when the golf ball 500 is located on or proximate the tee area 110.

Figure 6:
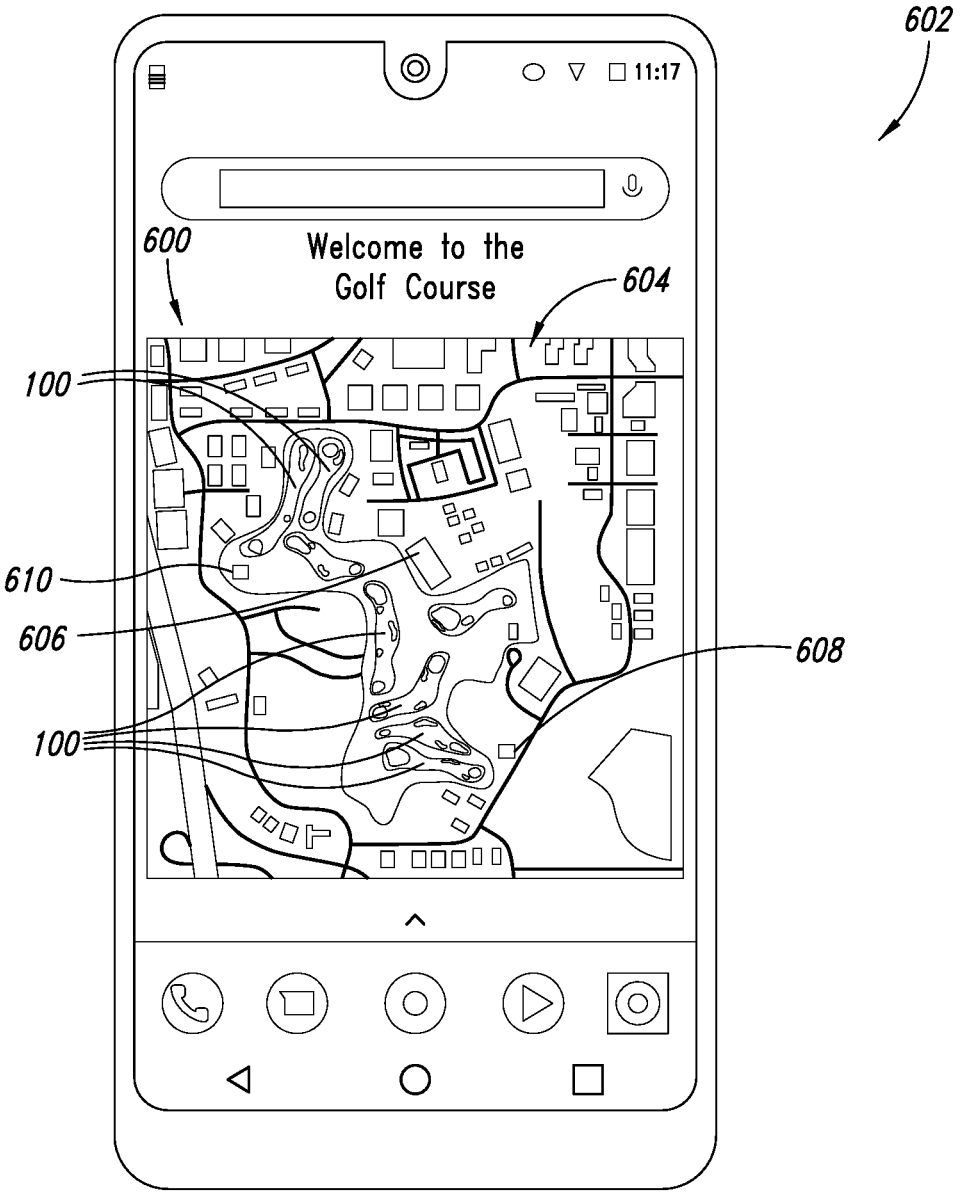
FIG. 6 illustrates a plan view of a plurality of golf course playing surfaces along with various amenities as rendered on a display device.

FIG. 6 shows an overview 600 of a plurality of golf course playing surfaces 100 along with various amenities as rendered on a display device 602. The overview 600 may be used to provide an overview of a golf course 604, showing, for example, the relative locations of each of the golf course playing surfaces 100 along with locations of various amenities located within and/or proximate the golf course 604. Such amenities may include, for example, a club house 606, rest rooms 608, and/or beer/drink carts 610 located along the golf course 604. In some implementations, the overview 600 may serve as an introduction page, for example, to an application (e.g., an "app") that may be used to access services for the golf course 604. Such services may include, for example, the ability to request tee times, the ability to zoom into individual golf course playing surfaces 100 to obtain information about the golf course playing surface 100, and/or the ability to order beverages and/or food for upcoming golf course playing surfaces 100.

In some implementations, the display device 602 may render a depiction of an individual golf course playing surface 100 (e.g., a single hole). In some implementations, the display device 602 may be used to render additional information that may be tailored to the golf course playing surface and/or the golf player. For example, the display device 602 may be used to render weather information, such as temperature, wind speed, and/or wind direction information, that may be used by the player to assist in striking the golf ball. In some implementations, the display device 602 may be used to render information related to the golf course playing surface 100, such as by displaying distance to the hole and/or par for the hole, by suggesting stroke placement for an upcoming stroke, or by showing locations of one or more services (e.g., beer or food cart, or restrooms). In some implementations, the display device 602 may be used to render information relevant to the golf player, such as by suggesting a club type to use or the player's current score. Such information and analytics may be continuously updated based upon new input related to the player.

Figure 7A:
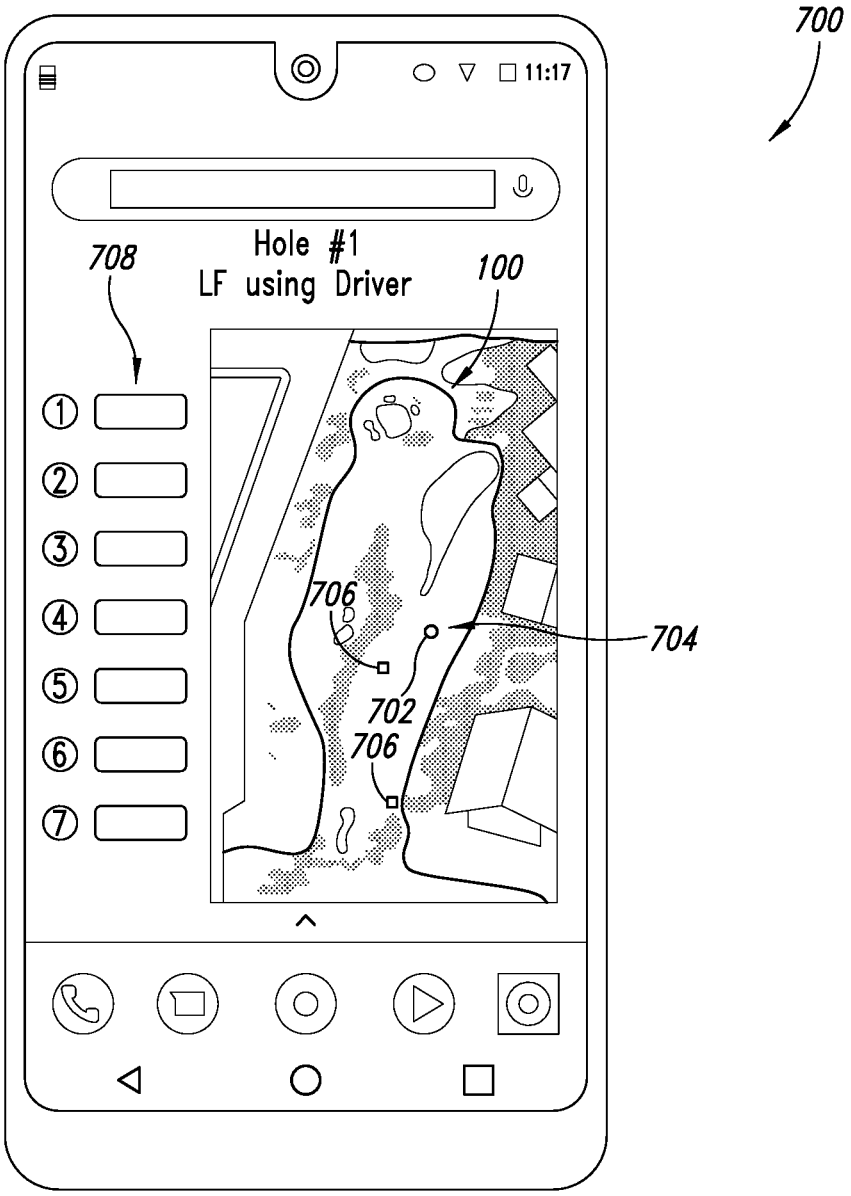
FIG. 7A illustrates a plan view of a golf course playing surface as rendered by a display device in which the plan view includes a marker indicating a current location of a golf ball.

FIG. 7A shows a display device 700 that renders a depiction of a golf course playing surface 100 that includes a marker 702 indicating a current location 704 of a golf ball. The depiction of the golf course playing surface 100 may include sensor indications 706 of one or more sensors located within and/or proximate the golf course playing surface 100. The marker 702 may be based upon a determined resting location of the golf ball based upon one or more of the images and/or signals received from the sensors as shown by the sensor indications 706. The marker 702 may be used to assist a player to find the physical golf ball as located along and/or within the physical golf course playing surface. In some implementations, the display device 700 may include a menu 708 that a player may use to select a display for a specific hole and/or golf course playing surface 100 at the golf course. In some implementations, the display device 700 may be used to show markers 702 for multiple golf balls on the golf course playing surface 100. The markers 702 for the multiple golf balls, which may belong to different golf players, may be depicted using different shapes and/or colors for the markers.

Figure 7B:
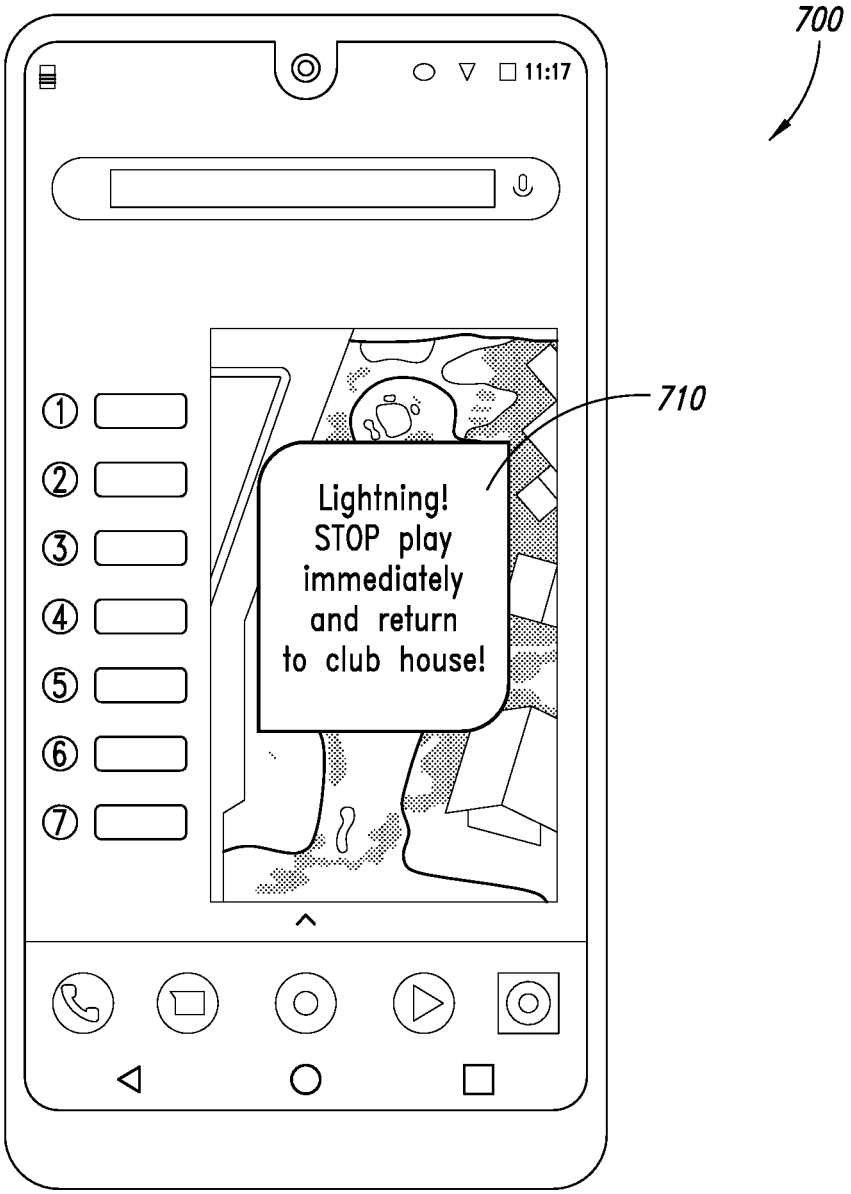
FIG. 7B illustrates the plan view of a golf course playing services rendered by a display device in which a notification is also rendered on the display device.

FIG. 7B shows the display device 700 that renders a depiction of a notification 710 to a player who is located at one of the golf course playing surfaces 100. Such notifications 710 may be transmitted to players located at all golf course playing surface 100, such as, for example, when events such as inclement weather may have an impact on players at all golf course playing surfaces 100. In some instances, the notifications 710 may be transmitted to players located at one or a subset of the golf course playing surface 100 at a golf course. Such targeted notifications 710 may be transmitted, for example, when events occur that impact only one or a subset of the golf course playing surfaces 100. Such targeted notifications 710 may be transmitted, for example, when a beer or food cart is located at or near a golf course playing surface 100 at which the player is located. In some implementations, the notifications 710 may be pushed to the display device 700 when certain criteria are met (e.g., when an event occurs at or proximate the golf course playing surface 100 at which the player is located). In some implementations, the player may need to request updates and/or notifications from the app before the notification 710 will be rendered on the display device 700.

Figure 8:
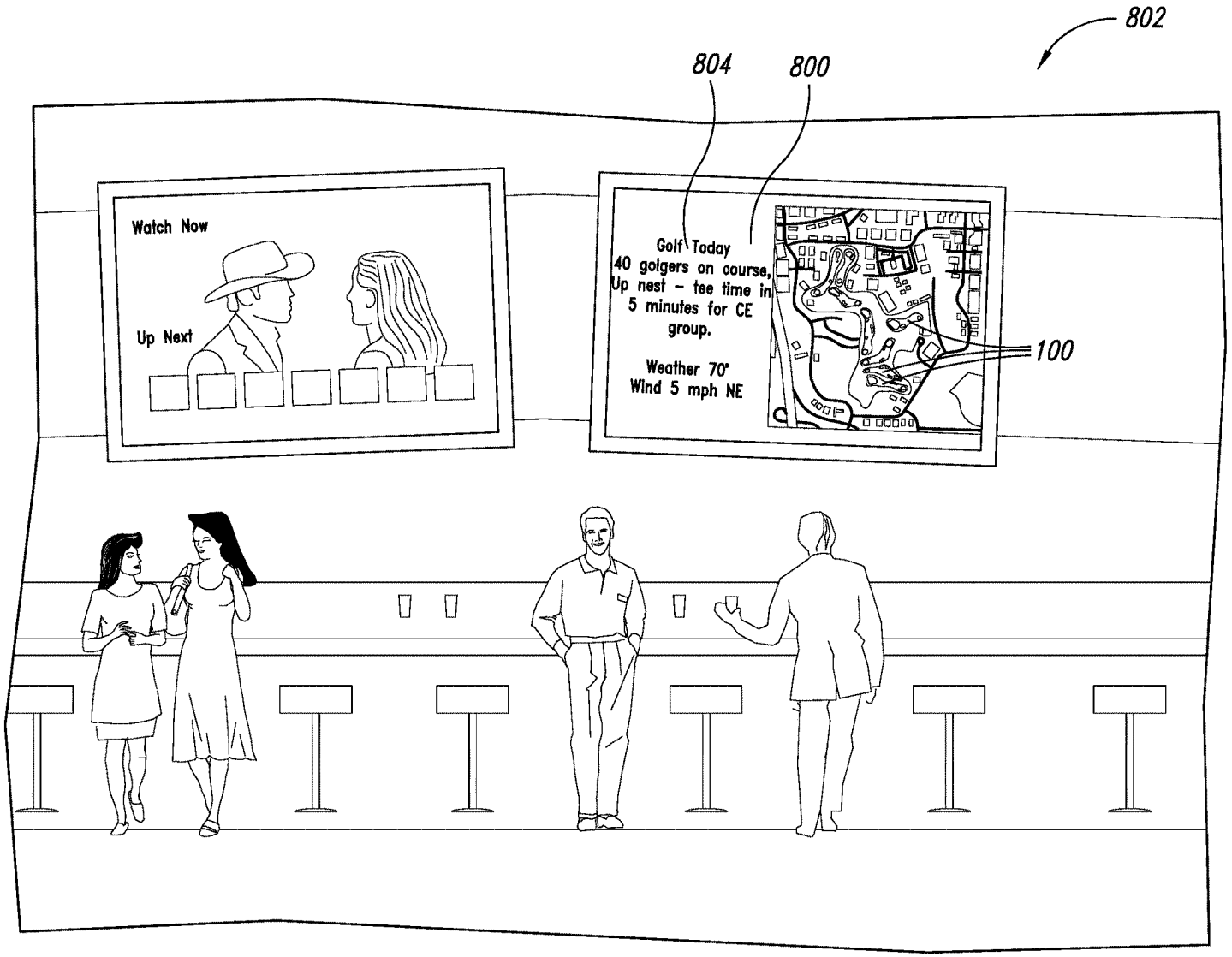
FIG. 8 illustrates a screen display device located within a public area that displays information and notifications related to one or more of the golf course playing surfaces.

FIG. 8 shows a display device 800 that is located within a public area 802 that displays information and notifications 804 related to one or more of the golf course playing surfaces 100. Such notifications 804 may be used to keep people, including players who are awaiting their turn on the golf course, up to date regarding the current status of the state of play on the golf course. Such up to date status information may include, for example, a status update as to when upcoming players may begin their game. In some implementations, the notifications 804 on the display device 800 may include information such as weather information that players may find useful. In some implementations, the notifications 804 rendered on the display device 800 may be used to alert players to report to the first golf course playing surface 100 to being their game. In some implementations, the display device 800 may display one or more images or videos from one or more of the image sensors located along one or more of the golf course playing surface 100.

Figure 9:
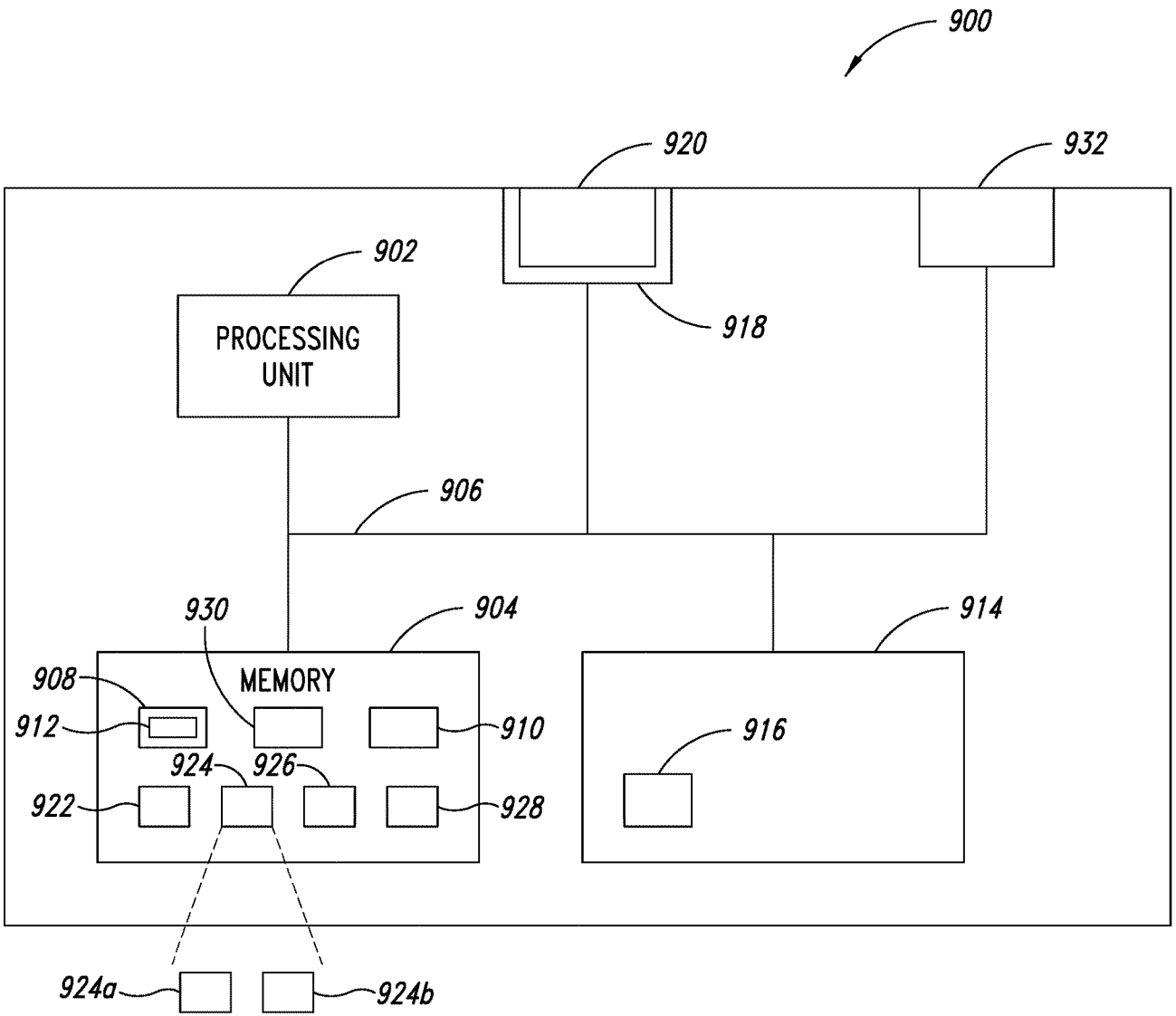
FIG. 9 illustrates a block diagram of a processor-enabled device that is used the currently disclosed methods.

FIG. 9 shows a processor-enable device 900 that is used the currently disclosed methods. The processor-enabled device 900 may take the form of any current or future developed computing system capable of executing one or more instruction sets. The processor-enabled device 900 includes a processing unit 902, a system memory 904, and a system bus 906 that communicably couples various system components including the system memory 904 to the processing unit 902. The processor-enabled device 900 will at times be referred to in the singular herein, but this is not intended to limit the embodiments to a single system, since in certain embodiments, there will be more than one system or other networked computing device involved. Non-limiting examples of commercially available systems include, but are not limited to, an Atom, Pentium, or 80×86 architecture microprocessor as offered by Intel Corporation, a Snapdragon processor as offered by Qualcomm, Inc., a PowerPC microprocessor as offered by IBM, a Sparc microprocessor as offered by Sun Microsystems, Inc., a PA-RISC series microprocessor as offered by Hewlett-Packard Company, an A6 or A8 series processor as offered by Apple Inc., or a 68xxx series microprocessor as offered by Motorola Corporation.

The processing unit 902 may be any logic processing unit, such as one or more central processing units (CPUs), microprocessors, digital signal processors (DSPs), application-specific integrated circuits (ASICs), field programmable gate arrays (FPGAs), programmable logic controllers (PLCs), etc. Unless described otherwise, the construction and operation of the various blocks shown in FIG. 9 are of conventional design. As a result, such blocks need not be described in further detail herein, as they will be understood by those skilled in the relevant art.

The system bus 906 can employ any known bus structures or architectures, including a memory bus with memory controller, a peripheral bus, and a local bus. The system memory 904 includes read-only memory ("ROM") 908 and random access memory ("RAM") 910. A basic input/output system ("BIOS") 912, which can form part of the ROM 908, contains basic routines that help transfer information between elements within the processor-enabled device 900, such as during start-up. Some embodiments may employ separate buses for data, instructions and power.

The processor-enabled device 900 also includes one or more internal nontransitory storage systems 914. Such internal nontransitory storage systems 914 may include, but are not limited to, any current or future developed persistent storage device 916. Such persistent storage devices 916 may include, without limitation, magnetic storage devices such as hard disc drives, electromagnetic storage devices such as memristors, molecular storage devices, quantum storage devices, electrostatic storage devices such as solid state drives, and the like.

The processor-enabled device 900 may also include one or more optional removable nontransitory storage systems 918. Such removable nontransitory storage systems 918 may include, but are not limited to, any current or future developed removable persistent storage device 920. Such removable persistent storage devices 920 may include, without limitation, magnetic storage devices, electromagnetic storage devices such as memristors, molecular storage devices, quantum storage devices, and electrostatic storage devices such as secure digital ("SD") drives, USB drives, memory sticks, or the like.

The one or more internal nontransitory storage systems 914 and the one or more optional removable nontransitory storage systems 918 communicate with the processing unit 902 via the system bus 906. The one or more internal nontransitory storage systems 914 and the one or more optional removable nontransitory storage systems 918 may include interfaces or device controllers (not shown) communicably coupled between nontransitory storage system and the system bus 906, as is known by those skilled in the relevant art. The nontransitory storage systems 914, 918, and their associated storage devices 916, 920 provide nonvolatile storage of computer-readable instructions, data structures, program modules and other data for the processor-enabled device 900. Those skilled in the relevant art will appreciate that other types of storage devices may be employed to store digital data accessible by a computer, such as magnetic cassettes, flash memory cards, RAMs, ROMs, smart cards, etc.

Program modules can be stored in the system memory 904, such as an operating system 922, one or more application programs 924, other programs or modules 926, drivers 928 and program data 930.

The application programs 924 may include, for example, one or more machine executable instruction sets (i.e., trajectory/velocity module 924*a*) capable of determining one or more of a trajectory and/or velocity of a golf ball based upon one or more signals received from one or more sensors. The application programs 694 may include, for example, one or more machine executable instruction sets (i.e., resting location module 924*b*) capable of determining a resting location of a golf ball along or adjacent a golf course playing surface.

In some embodiments, the processor-enabled device 900 operates in an environment using one or more of the network interfaces 932 to optionally communicably couple to one or more remote computers, servers, display devices, and/or other devices via one or more communications channels. These logical connections may facilitate any known method of permitting computers to communicate, such as through one or more LANs and/or WANs. Such networking environments are well known in wired and wireless enterprise-wide computer networks, intranets, extranets, and the Internet.

Figure 10:
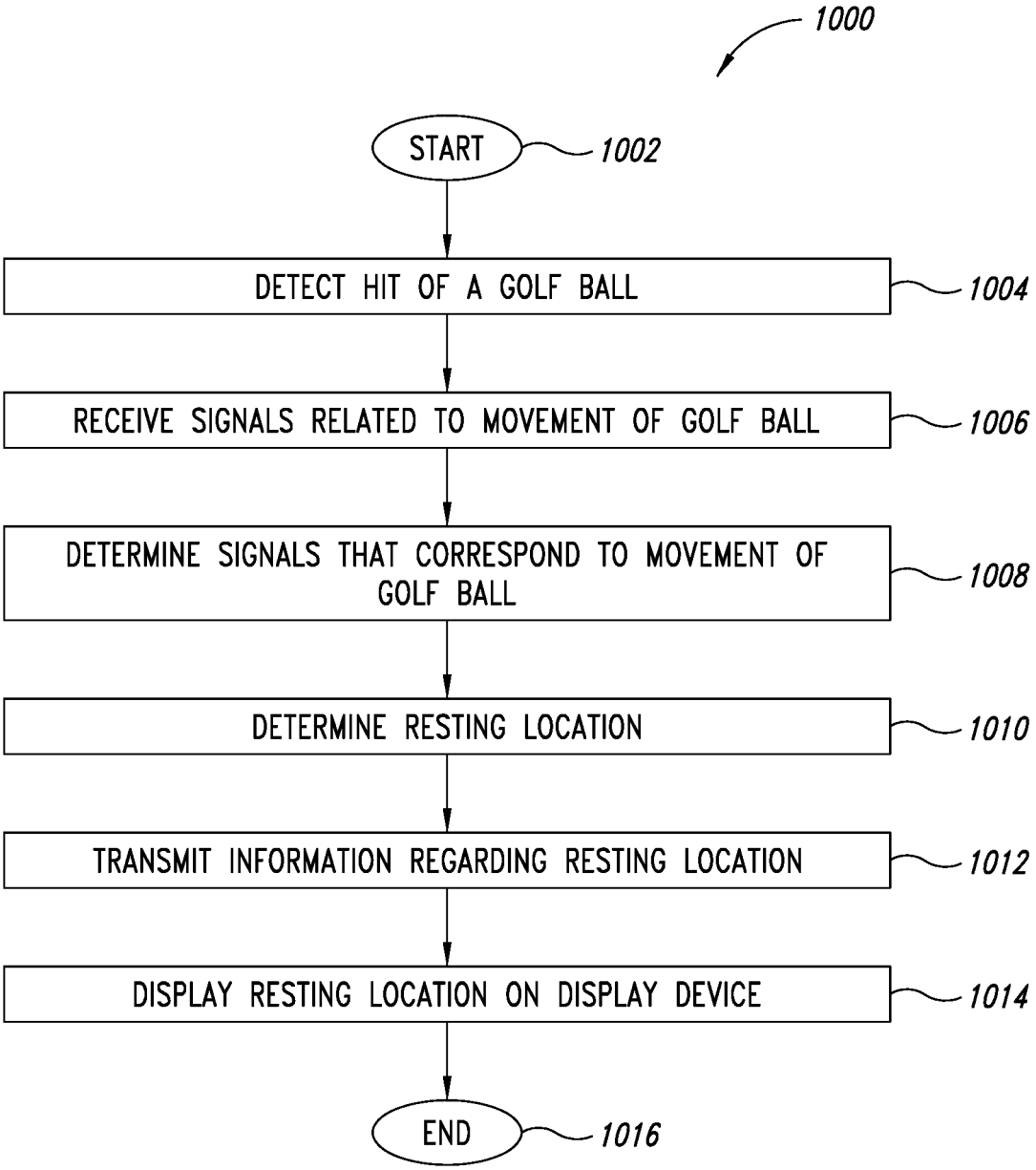
FIG. 10 is a method for determining a current location of a golf ball along a golf course playing surface and rendering a display to indicate the current location.

FIG. 10 shows a flow diagram 1000 for a method of operation of a processor-enabled device 900 to determine a current location of a golf ball along a golf course playing surface and rendering a display to indicate the current location. The method 1000 can, for example, be executed by one or more processor-enabled devices 900 and may start at 1002.

At 1004, the processor-enabled device 900 may receive one or more signals indicating that a golf ball has been struck by a player. Such signals may include, for example, signals received from an audio transducer that may be located next to or proximate a tee area. In such a situation, the audio transducer may generate signals indicative of sounds that are generated when the golf ball is struck by a golf club. In some implementations, for example, the striking of the golf ball by the golf club may result in a sound that is within a known frequency range. Accordingly, the processor-enabled device 900 may be programmed to detect signals from the audio transducer indicating the presence of a sound within the known frequency range. In such a situation, the processor-enabled device 900 may activate the other sensors, such as the motion detecting sensors and/or the image sensors, located along and/or adjacent the golf course playing surface.

At 1006, the processor-enabled device 900 may receive one or more signals from the sensors located along and/or adjacent the golf course playing surface. Such sensors may be, for example, motion detecting sensors that may generate signals indicative of the direction and velocity of travel of objects located on the golf course playing surface. In some implementations, the sensors located along or proximate the golf course playing surface may be activated upon the processor-enabled device detecting that a golf ball had been struck at 1004.

At 1008, the processor-enabled device 900 may determine that that the signals received at 1006 indicate that a golf ball is traveling along the golf course playing surface. As such, for example, a golf ball that is traveling after being struck may exhibit specific characteristics in terms of how it travels as a result of being struck by a golf club. In such situations, the processor-enabled device 900 may determine measurements of the golf ball based upon the received signals after determining that a golf ball is present. These determined measurements may include an impact location, velocity, direction of travel, acceleration/deceleration, and an estimated resting location for the golf ball.

In some instances, the processor-enabled device 900 may receive a plurality of signals from a plurality of sensors located along and/or proximate to the golf-course, playing surface. In such a situation, the processor-enabled device 900 may use only the strongest signal from the received signals to determine the measurements for the golf ball. Alternatively, the processor-enabled device may combine two or more of the signals in order to determine the measurements. For example, the process-enabled device could determine the average of the two or more signals to determine the measurements for the golf ball. In some such implementations, the average could be a weighted average of the received signals.

At 1010, the processor-enabled device 900 may determine the resting location for the golf ball based upon measurements that had been determined at 1008. For example, in some implementations, the processor-enabled device 900 may identify an initial impact location, a velocity, and a direction of travel for the golf ball. The processor-enabled device 900 may then use this information to determine the final resting location for the golf ball. In such situations, the processor-enabled device 900 may store or otherwise have access to a table that may associate a resting location with a set of velocities (or velocity ranges) and direction of travel. Upon determining the velocity and direction of travel for the golf ball, the processor-enabled device 900 may associate the corresponding resting location with the golf ball.

At 1012, the information related to the determined or estimated resting location for the golf ball is transmitted in a message to a display device of a player associated with the lost golf ball. In such situations, the message may be transmitted using any of a number of well-known communicating protocols At 1014, the display device displays a depiction of the resting locations of the golf ball. Such a depiction may include, for example, a marker or other indicator that indicates the location of a golf ball. In some implementations, the display device may render images in which the different golf balls are each depicted using a different color or shape for the marker. The location of the marker on the image may be updated in real time as the golf ball is repeea At 1016, the method 1000 terminates, for example until invoked again. Alternatively, the method 1000 may repeat continuously or repeatedly, or may execute as multiple instances of a multi-threaded process.

References to the term "set" (e.g., "a set of items"), as used herein, unless otherwise noted or contradicted by context, is to be construed as a nonempty collection comprising one or more members or instances.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected," when unmodified and referring to physical connections, is to be construed as partly or wholly contained within, attached to or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein.

Conjunctive language, such as phrases of the form "at least one of A, B, and C," or "at least one of A, B and C," unless specifically stated otherwise or otherwise clearly contradicted by context, is otherwise understood with the context as used in general to present that an item, term, etc., may be either A or B or C, or any nonempty subset of the set of A and B and C. For instance, in the illustrative example of a set having three members, the conjunctive phrases "at least one of A, B, and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present.

Operations of processes described herein can be performed in any suitable order unless otherwise indicated herein or otherwise clearly contradicted by context. Processes described herein (or variations and/or combinations thereof) may be performed under the control of one or more computer systems configured with executable instructions, and may be implemented as code (e.g., executable instructions, one or more computer programs or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory.

The use of any and all examples, or exemplary language (e.g., "such as") provided herein, is intended merely to better illuminate embodiments of the invention, and does not pose a limitation on the scope of the invention unless otherwise claimed. No language in the specification should be construed as indicating any non-claimed element as essential to the practice of the invention.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method to determine a resting location for a golf ball, the method comprising:

receiving a plurality of signals from a plurality of sensors in an array of sensors that are arranged along a golf course playing surface, each sensor in the array having a sensing field that includes, a portion of the golf course playing surface;

determining by a processor that the plurality of signals correspond to signals generated by the golf ball traveling along the golf course playing surface;

determining, by the processor and motion detecting sensors, a location on the golf course playing surface that the golf ball first contacts after being hit by a player by detecting a change in trajectory of the golf ball from a first trajectory to a second different trajectory after the golf ball makes contact, the second different trajectory including a velocity and new direction of travel;

using the second different trajectory of the golf ball to identify a resting location of the golf ball along or adjacent to the golf course playing surface;

transmitting an indication of the resting location for the golf ball; and displaying a marker indicating the resting location of the golf ball on a display device.

2. The method of claim 1, further comprising:

receiving a signal from an audio transducer located along the golf course playing surface;

determining by the processor that the signal corresponds to a head of a golf club making contact with the golf ball in golf stroke; and activating the array of sensors to begin sensing based upon the signal received from the audio transducer.

3. The method of claim 1 wherein receiving the plurality of signals further includes receiving the plurality of signals from a plurality of motion sensors.

4. The method of claim 3 wherein receiving the plurality of signals from the plurality of motion sensors further includes receiving the plurality of signals from a plurality of motion detecting sensors, the method further comprising:

transmitting from each of the motion detecting sensors an infrared signal that is directed towards the respective field-of-view for each infrared sensor; and receiving a reflected infrared signal at each of the plurality of motion detecting sensors, the reflected infrared signal which corresponds to a portion of the transmitted infrared signal that is reflected from the golf ball as the golf ball travels through the respective field of view of each infrared sensor.

5. The method of claim 3, further comprising:

transmitting from each of the motion sensors an ultrasound wave that is directed towards the respective field-of-view for each motion sensor; and receiving a reflected ultrasound signal at each of the plurality of motion sensors, the reflected ultrasound signal which corresponds to a portion of the transmitted ultrasound wave that is reflected from the golf ball as the golf ball travels through the respective field of view of each motion sensor.

6. The method of claim 1, further comprising:

capturing one or more images by at least one imaging device; and identifying by the at least one processor the golf ball in at least one image of the one or more images, wherein determining the resting location for the golf ball is based at least in part on the at least one image in which the golf ball is identified.

7. The method of claim 1 wherein determining the resting location for the golf ball is based at least in part on a location of the sensor in the plurality of sensors located closest to the green.

8. The method of claim 7, further comprising:

determining by the at least one processor a velocity associated with the golf ball based at least in part on the plurality of signals received from the plurality of sensors, wherein determining the resting location for the golf ball further includes determining the resting location based at least in part on the determined velocity associated with the golf ball.

9. The method of claim 8 wherein determining the resting location for the golf ball includes adding an amount to the location of the sensor in the plurality of sensors located closest to the green, the amount which is based at least in part on the determined velocity associated with the golf ball.

10. A method to display on a display device a resting location for a golf ball that is traveling along a golf course playing surface, the golf course playing surface which includes a tee area, a fairway, and a green, the method comprising:

determining, by the processor and motion detecting sensors, a location on the golf course playing surface that the golf ball first contacts after being hit by a player by detecting a change in trajectory of the golf ball from a first trajectory to a second different trajectory after the golf ball makes contact, the second different trajectory including a velocity and new direction of travel;

using the second different trajectory of the golf ball to identify a resting location of the golf ball along or adjacent to the golf course playing surface;

receiving a message at the display device that includes an indication of the resting location for the golf ball, the resting location which is determined by at least one processor based on a plurality of signals received by the at least one processor from a plurality of sensors in an array of sensors, the plurality of sensors in the array of sensors which are arranged along the golf course playing surface proximate at least one of the fairway and the green, wherein each sensor in the array of sensors has a field-of-view that includes, at least in part, a portion of the golf course playing surface;

rendering a representation of at least a portion of the golf course playing surface on the display device, the representation of the at least portion of the golf course playing surface which includes an identification of a location of each of the array of sensors arranged along the portion of the golf course playing surface; and including on the rendering of the representation of the portion of the golf course playing surface an identification of the resting location for the golf ball based upon the indication of the resting location received in the message.

11. The method of claim 10, further comprising:

receiving a second message at the display device that includes a second indication of a second resting location for a second golf ball, the second resting location which is determined by the at least one processor based on a second plurality of signals received by the at least one processor from a second plurality of sensors in the array of sensors, the second plurality of sensors in the array of sensors which are arranged along the golf course playing surface proximate at least one of the fairway and the green; and including on the rendering of the representation of the portion of the golf course playing surface a second identification of the second resting location for the second golf ball based upon the second indication of the second resting location received in the second message.

12. The method of claim 10, further comprising:

associating a personal identifier with the golf ball;

determining one or more types of measurements based upon one or more of the resting location of the golf ball and the plurality of signals received from the plurality of sensors; and associating the one or more types of measurements with the personal identifier.

13. The method of claim 12, wherein the one or more types of measurements include at least one of club used, a traveled distance associated with the resting location, a remaining distance from the resting location to a final destination for the golf ball, or a velocity of the golf ball.

14. The method of claim 12, further comprising:

determining a plurality of the one or more types of measurements based upon a plurality of resting locations of one or more golf balls associated with the personal identifier;

determining one or more analytics based upon the one or more types of measurements; and associating the one or more analytics with the personal identifier.

15. The method of claim 14 wherein the one or more analytics includes at least one of a score for a golf hole associated with the personal identifier, a score for a golf game associated with the personal identifier, average traveled distance for a golf ball, a handicap, or an average distance when a person associated with the personal identifier uses a respective one of a golf club.

16. The method of claim 10, further comprising:

receiving one or more messages containing environmental data, the environmental data which is associated with the portion of the golf course playing surface rendered on the display; and rendering the environmental data on the display.

17. The method of claim 10, further comprising:

retrieving golf course playing surface information associated with the portion of the golf course playing surface rendered on the display, the golf course playing surface information included at least one of par information or distance-to-hole information; and rendering the golf course playing surface information on the display.

18. The method of claim 10, further comprising:

receiving from an imaging device one or more images of the green associated with the portion of the golf course playing surface rendered on the display, the imaging device which has a field-of-view that includes at least a portion of the green;

identifying golfing activity on the green; and in response to identifying golfing activity on the green, rendering the one or more images of the green on the display.

19. The method of claim 18, wherein identifying golfing activity on the green is based upon one or more of the plurality of signals received from the plurality of sensors, or an identification of a shape corresponding to a person in one or more of the images of the green received from the imaging device.

20. A method to determine a resting location for a golf ball, the method comprising:

receiving a plurality of signals from a plurality of sensors in an array of sensors that are arranged along a golf course playing surface, each sensor in the array having a sensing field that includes, a portion of the golf course playing surface;

determining by a processor that the plurality of signals correspond to signals generated by the golf ball traveling along the golf course playing surface;

determining, by the processor and motion detecting sensors, a location on the golf course playing surface that the golf ball first contacts after being hit by a player by detecting a change in trajectory of the golf ball from a first trajectory to a second different trajectory after the golf ball makes contact, the second different trajectory including a velocity and new direction of travel;

using the second different trajectory of the golf ball to identify a resting location of the golf ball along or adjacent to the golf course playing surface; and transmitting an indication of the resting location for the golf ball, the indication which causes a marker of the resting location of the golf ball to be displayed on a display device.

* * * * *